United States Patent [19]

Lösel et al.

[11] 4,261,301

[45] Apr. 14, 1981

[54] TEMPERATURE HOLDING DEVICE FOR WATER COLLECTING VESSELS OF ONCE-THROUGH STEAM GENERATORS

[75] Inventors: Georg Lösel, Uttenreuth; Werner Emsperger, Erlangen, both of Fed. Rep. of Germany

[73] Assignee: Kraftwerk Union Aktiengesellschaft, Mülheim, Fed. Rep. of Germany

[21] Appl. No.: 33,104

[22] Filed: Apr. 25, 1979

[30] Foreign Application Priority Data

Apr. 28, 1978 [DE] Fed. Rep. of Germany ..... 2818981

[51] Int. Cl.[3] ..... F22B 29/12

[52] U.S. Cl. ..... 122/406 S; 122/406 ST; 122/429 S

[58] Field of Search ..... 122/406 R, 406 S, 406 ST, 122/451 S, 448 S, 1 B, 479 S

[56] References Cited

U.S. PATENT DOCUMENTS

| | | | |
|---|---|---|---|
| 3,019,774 | 2/1962 | Beyerlein | 122/406 ST |
| 3,135,096 | 6/1964 | Schroedter | 122/406 ST |
| 3,411,300 | 11/1968 | Schuetzenduebel et al. | 122/406 S |
| 3,464,393 | 9/1969 | Chambers | 122/406 S |
| 3,954,087 | 5/1976 | Stevens et al. | 122/406 S |
| 4,068,475 | 1/1978 | Binstock | 122/406 ST |
| 4,099,384 | 7/1978 | Stevens et al. | 122/406 S |

FOREIGN PATENT DOCUMENTS

| | | | |
|---|---|---|---|
| 1155291 | 6/1969 | United Kingdom | 122/406 S |

*Primary Examiner*—Edward G. Favors
*Attorney, Agent, or Firm*—Herbert L. Lerner

[57] ABSTRACT

In a temperature holding device for water collecting vessels of steam generators operable in once-through and circulating operation, having a feed-water line leading to the once-through steam generator, an evaporator and a superheater heating surface in the feed-water line, water-steam separating vessels intermediate the evaporator and superheater heating surface, a return line for returning water from the separating vessel to the feed-water line, a circulating pump and a first valve arrangement in the return line, a warm-up line having one end connected to the feed-water line before the evaporator, and another end connected to the return line intermediate the circulating pump and first valve arrangement, and a second valve arrangement in the warm-up line. A common water collecting vessel connected to outlets on the water side of the separating vessels by partial lines of the return line, a steam line connected from the steam side of the common water collecting vessel to an input of the superheater heating surface, and a shut-off valve in the steam line being closable in once-through operation and openable in circulating operation.

2 Claims, 1 Drawing Figure

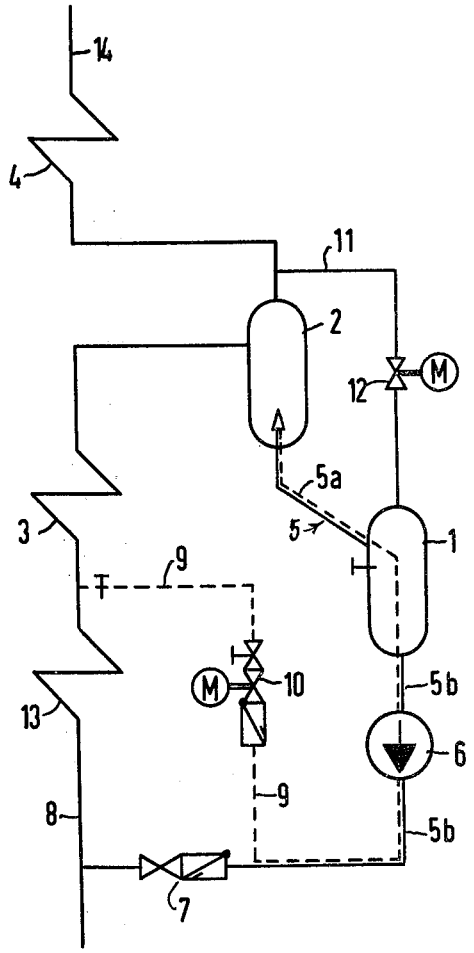
14
4
11
2
12
M
5a
5
1
3
9
10
M
5b
13
6
9
8
5b
7

TEMPERATURE HOLDING DEVICE FOR WATER COLLECTING VESSELS OF ONCE-THROUGH STEAM GENERATORS

The invention relates to a temperature holding device for water collecting vessels of once-through or continuous-flow steam generators with water-steam separating vessels which are disposed intermediate an evaporator and a superheater heating surface. The return lines for the water are connected to the feed water line leading to the once-through steam generator through a circulating pump and a first valve arrangement. A warm-up line branches off ahead of the evaporator heating surface and leads through a second valve arrangement, into the return line between the circulating pump and the first valve arrangement.

Such a device is described in German Published, Prosecuted Application DE-AS No. 12 30 436. In that patent, the valve arrangement in the warm-up line is opened if the circulating pump is not in operation. Water at substantially the boiling point flows backward through the circulating pump so that it cannot cool down to room temperature.

It is accordingly an object of the invention to provide a temperature holding device for water collecting vessels of once-through steam generators which overcomes the hereinafore-mentioned disadvantages of the heretofore known devices of this general type and to provide an apparatus in which the conventional device for keeping the circulating pump warm is additionally utilized in a once-through steam generator with a water collecting vessel common to several water-steam separating vessels to ensure that the water collecting vessel does not participate in the temperature change if the steam generator is operated with variable pressure.

Since the wall thickness of a water vessel common to several water-steam separating vessels must be made substantially heavier than the wall thickness of the smaller water-steam separating vessels, it is important for the control of once-through steam generators in variable pressure separation, to be able to dispense with considering the permissible temperature change of the water collecting vessel.

With the foregoing and other objects in view, there is provided, in accordance with the invention, in a temperature holding device for water collecting vessels of steam generators operable in once-through and circulating operation, having a feed water line leading to the once-through steam generator, an evaporator and a superheater heating surface disposed in the feed water line, at least one water-steam separating vessel disposed in the feed water line intermediate the evaporator and superheater heating surface, a return line for returning water from the separating vessel to the feed water line, a circulating pump and a first valve arrangement disposed in the return line, a warm-up line having one end thereof connected to the feed water line before the evaporator, in flow direction of the feed water, and having another end thereof connected to the return line intermediate the circulating pump and first valve arrangement, and a second valve arrangement disposed in the warm-up line, a common water collecting vessel connected to outlets on the water side of the at least one collecting vessel by partial lines of the return line, a steam line connected from the steam side of the common water collecting vessel to an input of the superheater heating surface, and a shut-off valve disposed in the steam line, the shut-off valve being closable in once-through operation and openable in circulating operation.

In accordance with a concomitant feature of the invention, the second valve arrangement is closable in circulating operation and openable in once-through operation.

Other features which are considered as characteristic for the invention are set forth in the appended claims.

Although the invention is illustrated and described herein as embodied in a temperature holding device for water collecting vessels of once-through steam generators, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single feature of the drawing, in which the single figure of the drawing is a schematic diagram of an embodiment of the invention.

Referring now particularly to the FIGURE of the drawing, there is seen a feedwater line 8. The feedwater in the line 8 flows through an economizer 13 to an evaporating heating surface 3, through several water-steam separating vessels 2, into a superheater heating surface 4 and from there into the main steam line 14 of a once-through or continuous-flow generator.

For starting up, and for partial-load operation, the outlets of the water-steam separating vessels 2, on the water side, are brought through partial lines 5*a* of a return line 5 for the separated water to a water collecting vessel 1 common to several water-steam separating vessels 2.

A further partial line 5*b* of the return line 5 branches off from the water collecting vessel 1. Through the partial line 5*b*, the water flows through a circulating pump 6, and a first valve arrangement 7 into the feed water line 8. The valve arrangement 7 includes a control and a check valve which lets the water pass through in the pumping direction of the circulating pump 6.

A warm-up line 9, into which a second valve arrangement 10 is inserted, branches off between the economizer 13 and the evaporator heating surface 3. The warm-up line 9 leads into the return line 5 between the circulating pump 6 and the first valve arrangement 7. The second valve arrangement 10 similarly contains a check valve which, however, lets water flow only in the direction opposite to the pumping direction of the circulating pump 6.

The outlet of the water collecting vessel 1, on the steam side thereof, is connected through a steam line 11 having a shut-off valve 12 inserted therein, to the input of the superheater heating surface 4. In continuous or constant-pressure operation a certain amount of steam would flow through this steam line 11, so that at least at the upper part of the water collecting vessel 1, the temperature thereof would follow the temperature change of the steam in continuous or constant-pressure operation. In a once-through or continuous-flow operation, the shut-off valve 12 now is closed in accordance with the invention, so that only the water flowing through the warm-up line 9 flows through the water collecting vessel 1, and thereby keeps the temperature of the water collecting vessel constant overall. The water from the warm-up line 9 enters the return line 5 in vicinity of the pump 6 and passes through the water collecting vessel 1 after a clockwise flow through the system according to the drawing.

When going to circulating operation, the circulating pump 6 is placed into operation and the shut-off valve 12 in the steam line 11 is opened. The valve arrangement 10 is then shut off and the water which is separated in the water-steam separating vessel 2 and collected in water collecting vessel 1, is returned to the feedwater line 8 through the circulating pump 6 and the valve arrangement 7.

There is claimed:

1. In a temperature holding device for water collecting vessels of steam generators operable in once-through and circulating operation, having a feed-water line leading to the once-through steam generator, an evaporator and a superheater heating surface disposed in said feed-water line, at least one water-steam separating vessel disposed in said feed-water line intermediate said evaporator and superheater heating surface, a return line for returning water from said separating vessel to said feed-water line, a circulating pump and a first valve arrangement disposed in said return line, a warm-up line having one end thereof connected to said feed-water line before said evaporator, in flow direction of the feed-water, and having another end thereof connected to said return line intermediate said circulating pump and first valve arrangement, and a second valve arrangement disposed in said warm-up line, a common water collecting vessel connected to outlets on the water side of said at least one separating vessel by partial lines of said return line, a steam line connected from the steam side of said common water collecting vessel to an input of said superheater heating surface, and a shut-off valve disposed in said steam line, said shut-off valve being closable in once-through operation and openable in circulating operation.

2. Device according to claim 1, wherein said second valve arrangement is closable in circulating operation and openable in once-through operation.

* * * * *